US011976532B2

(12) United States Patent
Berryman et al.

(10) Patent No.: US 11,976,532 B2
(45) Date of Patent: May 7, 2024

(54) SLIP ASSEMBLY FOR DOWNHOLE TOOL AND METHOD THEREFOR

(71) Applicant: Tryton Tool Services Limited Partnership, Edmonton (CA)

(72) Inventors: Randy Berryman, Edmonton (CA); Tyler Lindstrand, Edmonton (CA)

(73) Assignee: Tryton Tool Services Limited Partnership, Edmonton (CA)

( * ) Notice: Subject to any disclaimer, the term of this patent is extended or adjusted under 35 U.S.C. 154(b) by 0 days.

(21) Appl. No.: 17/448,494

(22) Filed: Sep. 22, 2021

(65) Prior Publication Data

US 2022/0090464 A1 Mar. 24, 2022

Related U.S. Application Data

(60) Provisional application No. 62/706,989, filed on Sep. 22, 2020.

(51) Int. Cl.
*E21B 33/129* (2006.01)
*E21B 23/06* (2006.01)

(52) U.S. Cl.
CPC ..... *E21B 33/1292* (2013.01); *E21B 23/06* (2013.01)

(58) Field of Classification Search
CPC ..... E21B 33/128; E21B 33/1282; E21B 23/06
See application file for complete search history.

(56) References Cited

U.S. PATENT DOCUMENTS 2,715,441 A * 8/1955 Bouvier ..... E21B 33/1294 166/138
4,018,274 A * 4/1977 Cochran ..... E21B 33/1292 166/182
5,904,207 A * 5/1999 Rubbo ..... E21B 33/1293 166/123
2005/0034894 A1* 2/2005 Beach ..... E21B 25/16 175/244
2020/0308921 A1* 10/2020 Hrupp ..... E21B 43/261

OTHER PUBLICATIONS

Schlumberger. (2014). Versalok: Conventional wireline-set packer [brochure].

* cited by examiner

*Primary Examiner* — D. Andrews
*Assistant Examiner* — Ronald R Runyan
(74) *Attorney, Agent, or Firm* — CPST Intellectual Property Inc.; Santosh K. Chari

(57) ABSTRACT

A slip assembly comprises a plurality of slips provided over a mandrel of a downhole tool, at least one generally cylindrical cone body slidably provided over the mandrel, and at least one biasing member coaxially provided over the mandrel and adapted to apply an axial force against the cylindrical body to maintain the slips in a radially extended position when the tool is set.

20 Claims, 11 Drawing Sheets

SLIP ASSEMBLY FOR DOWNHOLE TOOL AND METHOD THEREFOR

CROSS REFERENCE TO RELATED APPLICATION

The present application claims priority under 35 U.S.C. 119 to U.S. Application No. 62/706,989, filed Sep. 22, 2020, the entire contents of which are incorporated herein by reference.

FIELD OF THE DESCRIPTION

The following description generally relates to slip assemblies incorporated into downhole tools, such as packers and the like, for use in hydrocarbon wells. In one particular aspect, the present description relates to a retrievable packer with slips that are, in one aspect, actuated bi-directionally.

BACKGROUND

In the field of hydrocarbon production, a wellbore is drilled into a hydrocarbon-containing subterranean formation, and a tubing string, or production tubing, is then provided within the wellbore for providing fluid communication from the formation to the surface. In many applications, a casing may also be provided to line the wellbore. In other cases, the wellbore may be left uncased, in which case, the wellbore surface would function as the casing. Tubing strings comprise a plurality of generally axially (i.e., end to end) connected tubular elements, along with any number of tools, or "tool subs", which are also provided coaxially as part of the tubing string. Such tools may include valves, packers, etc., which aid in either the production of fluids (in particular hydrocarbon materials) entering the wellbore, or in stimulating a subterranean region proximal to the wellbore. Many such tools would be known in the art.

Packers are well known in the art and serve to isolate one or more zones of a wellbore. An isolated zone may then be selected for production of hydrocarbon materials from the adjacent region of the well. Alternatively, the isolated zone may be subjected to a stimulation procedure for causing or enhancing production. For achieving the zonal isolation, packers comprise one or more radially expandable sealing elements, which are formed of a resilient material, such as rubber. The expansion of the sealing elements can be achieved by mechanically compressing the elements, or by causing such elements to swell. In the case of mechanically compressed packing elements, the actuation, or setting, of packers can be accomplished either mechanically, by running an actuation tool downhole on wireline, or hydraulically, by pressurizing the bore of the tubing string. In both cases, actuation, or setting of the packer causes an axial compressive force to be applied on the resilient packing elements, which results in the radial expansion of such elements. In this way, when the packer is set, the sealing element(s) expand radially outward against the casing of a wellbore to form a seal between the casing and the packer. By providing a pair of packers spaced apart on a tubing string, an isolated annular region is thereby formed in the well, bounded by the tubing string, the casing, and the actuated packing elements of the respective packers.

In some cases, the packers may also be unset and removed from the well or moved and reset at a different location. In such case, the axial force applied on the packing elements may be released, causing radial contraction of such elements. In such state, the tubing string comprising the packers may be removed or moved to a new location along the wellbore and reset as mentioned above.

It is also known to provide packers with slips, which generally comprise a number of rigid bodies having a plurality of teeth or the like on their outer surfaces. Upon actuation (setting) of the packer, the slips are moved radially outward and are thereby forced against the surface of the casing. In this way, the slips grip the interior surface of the casing and ensure that the packer is secured in position along the length of the casing. In particular, the slips serve to prevent axial displacement of the packer by supplementing the frictional forces created between the packing elements and the casing.

Slips generally comprise a wedge-shaped inner portion (opposite the gripping surface), which are designed to cooperate with an oppositely wedge-shaped member provided on the packer. The wedge-shaped member is typically in the form of a cone, which is slidably provided on the packer. During the setting process of the packer, the cone and slip are axially advanced against each other whereby the opposite wedge portions result in the slips being cammed or urged radially outward. Examples of packers having slips are provided in U.S. Pat. Nos. 7,198,110; 7,654,334; 9,291,029; 9,291,044; 10,633,942; and US/2004/0244966. In many of the known retrievable packers, springs or similar biasing means are also provided to urge the slips into the set or unset positions. In this way, the actuation of the packer serves to act against the action of such springs.

Although the slips are provided to supplement the frictional forces resulting from the expanded packing elements, they too are susceptible to being dislodged, such as in situations where pressure fluctuation, namely pressure reversals, occur in the well. There exists therefore a need for an improved slip mechanism that aids in counteracting the effects of pressure variations in a well.

SUMMARY OF THE DESCRIPTION

In a broad aspect, the present description provides a unique slip assembly, wherein the slips, once set, are maintained in an energized state by means of one or more biasing members that act upon cones that drive the slips.

In one aspect, the present description provides a slip assembly for a downhole tool, the slip assembly comprising:

- a mandrel having a longitudinal axis;
- a plurality of slips provided over the mandrel;
- at least one generally cylindrical cone body coaxially provided over the mandrel and slidable thereover, the cone body having a first end directed away from the slips, and a second, slip engaging end, facing the slips;
- at least one biasing member comprising a generally cylindrical body coaxially provided over the mandrel adjacent the first end of the at least one cone body, the biasing member being axially compressible and adapted to apply an axial force against the cylindrical body.

In another aspect, the description provides a slip system for a downhole tool, the slip system comprising:

- a mandrel having a longitudinal axis;
- a plurality of slips provided over the mandrel, each of the slips having:
- a longitudinal axis generally parallel to the longitudinal axis of the mandrel;
- a first face, directed radially away from the mandrel;
- a second face, directed towards the mandrel; and
- first and second ends;

at least one of the first and second ends having a ramped surface provided on the second face, whereby the length of the first face is longer than the second face;

at least one generally cylindrical cone body coaxially provided over the mandrel and slidable thereover, the at least one cone body having:

an inner surface facing the mandrel;

an outer surface facing away from the mandrel;

a first end directed away from the slips;

a second, slip engaging end, facing the slips;

the second end having a wedge surface, whereby the inner surface extends farther towards the slips that the outer surface;

wherein the wedge surface of the cone body is oppositely directed to the ramped surface of the slips, and whereby axial advancement of wedge surface towards the ramped surface forces radially outward movement of the slips; and, at least one biasing member comprising a generally cylindrical body coaxially provided over the mandrel adjacent the first end of the at least one cone body, the biasing member being axially compressible and adapted to apply an axial force against the cylindrical body.

In another aspect, the description provides a method of operating a slip assembly provided on a downhole tool, the slip assembly comprising a plurality of slips adapted to be radially outwardly extended, the method comprising:

running the tool with the slip assembly into a wellbore;

setting the tool and the slips;

maintaining an axial force on the slips for maintaining the slips in the set state.

BRIEF DESCRIPTION OF THE FIGURES

The features of certain embodiments will become more apparent in the following detailed description in which reference is made to the appended figures wherein.

DETAILED DESCRIPTION

Figure 1:
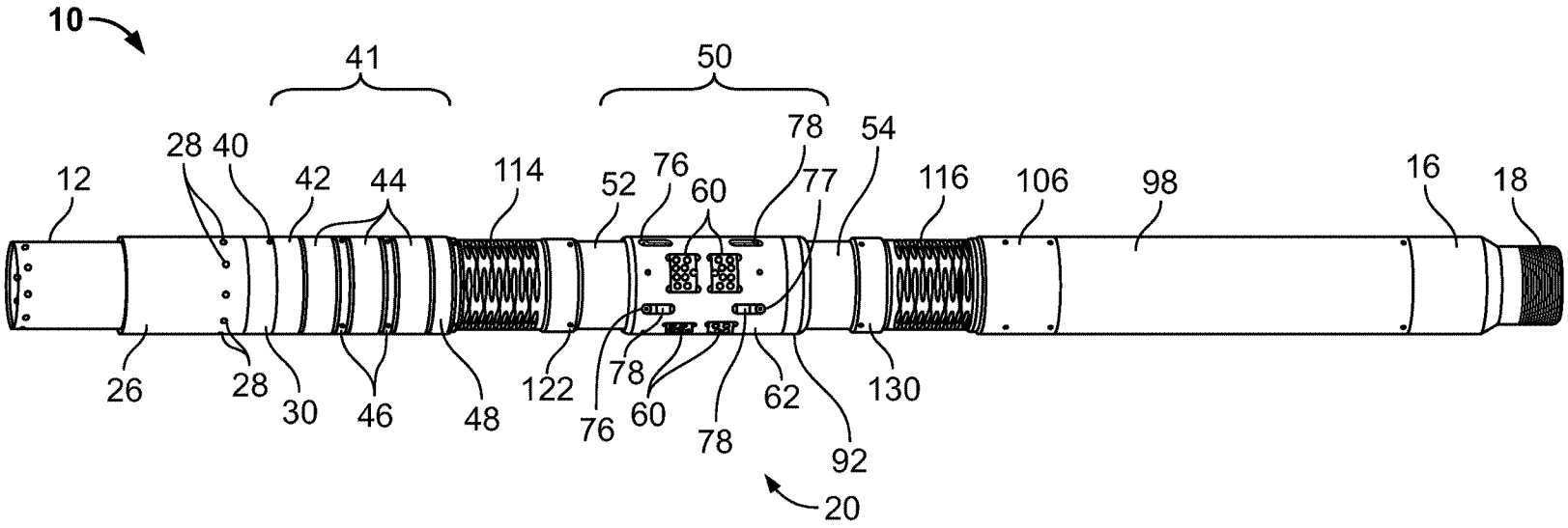
FIG. 1 is a side elevation view of a packer as described herein in the unset or run-in state.

As used herein, the term "sub" will be understood to mean a tubing string component, such as a tubular member, a coupling, a tool etc. as known in the art. As also known, a sub has a generally cylindrical structure and is adapted to be connected to adjacent tubular members, or other subs, to form the tubing string. As with typical tubular members, a sub may have a female or "box" end and a male or "pin" end. The box end includes an internal threaded portion that is adapted to receive and threadingly engage an external thread provided on a pin end of an adjacent component (e.g., a tubular member, a sub, or a tool etc.). In this way, all components of the tubular string are connected together in an end-to-end manner. Alternatively, the ends of the sub may be the same (i.e., both may be a box, or both may be a pin), in which case the sub can be connected to adjacent components by means of a coupling.

The term "tool" as used herein will be understood to refer commonly known tubing string components that are used for performing various tasks. Examples of tools include valves, such as sliding sleeve valves, packers, liner hangers, etc.

The terms "comprise", "comprises", "comprised" or "comprising" may be used in the present description. As used herein (including the specification and/or the claims), these terms are to be interpreted as specifying the presence of the stated features, integers, steps, or components, but not as precluding the presence of one or more other feature, integer, step, component, or a group thereof as would be apparent to persons having ordinary skill in the relevant art. Thus, the term "comprising" as used in this specification means "consisting at least in part of". When interpreting statements in this specification that include that term, the features, prefaced by that term in each statement, all need to be present but other features can also be present. Related terms such as "comprise" and "comprised" are to be interpreted in the same manner.

The term "and/or" if used herein can mean "and" or "or".

Unless stated otherwise herein, the article "a" when used to identify any element is not intended to constitute a limitation of just one and will, instead, be understood to mean "at least one" or "one or more" unless indicated otherwise.

The terms "top", "bottom", "up", or "down" may be used herein. It will be understood that these terms will be used purely for facilitating the description and, unless stated otherwise, are not intended in any way to limit the description to any spatial or positional orientation. In one example, the terms "top" or "uphole" may be used herein to refer to a direction along the tubing string or component towards the surface. Similarly, the terms "bottom" or "downhole" may be used herein to refer to a direction along the tubing string or component towards the bottom of the well, i.e., away from the surface.

The present description relates generally to a downhole tool for incorporation into a tubing string, where the tool comprises a number of slips arranged in a circumferentially spaced apart manner. The slips are urged radially outwardly by an urging means, such as a cone or other such ramped surface that is axially slidable along the longitudinal axis of the tool. The slips include cooperatively arranged ramped surfaces arranged opposite to the ramped surfaces of the urging means. In such arrangement, as the urging means is axially moved towards the slips, the slips are forced in a radially outward direction. Uniquely, the tool is provided with one or more biasing member associated with the urging means, whereby the urging means is/are maintained in an "energized" state, wherein the urging means constantly applies a degree of axial tension against the slips. These features are discussed in more detail below.

In one aspect, the tool described herein comprises a packer, in particular a retrievable packer that is preferably adapted to be set and re-set as needed. The packer comprises a number of slips along with the urging means and biasing member as described above.

One example of the presently described packer is illustrated in FIGS. 1 to 5, which illustrate the packer in the unset or run-in state. That is, these figures show the packer as it would appear when being run-in the well to a location where the packer is to be set. As shown, the packer 10 comprises a generally elongate, tubular body, which is adapted to be connected, end to end, to adjacent tubular members of a tubing string. Such tubular members may comprise plain tubulars or other tools that form a part of the tubing string.

As shown, the packer 10 comprises a top sub 12 and a bottom sub 16. In general, the top sub 12 is connected to the top, or uphole portion of the tubing string, and the bottom sub 16 is connected to the bottom, or downhole portion of the tubing string. In one aspect, the top sub 12 comprises a box end 14, for receiving a pin end of an adjacent tubular. Similarly, the bottom sub 16 comprises a pin end 18, for being received within a box end of an adjacent tubular member. A packer body 20 is provided between the top sub 12 and bottom sub 16. The packer body 20 is, in turn, comprised of several components as will be described below. As will be understood, the top sub 12 and bottom sub 16 are provided to facilitate the connection of the packer 10 to a tubing string. Such subs are generally provided on packers as separate units that are connected to the packer body 20. However, it will be understood that such subs may also be integrally formed with one or more components of the body 20.

Figure 2:
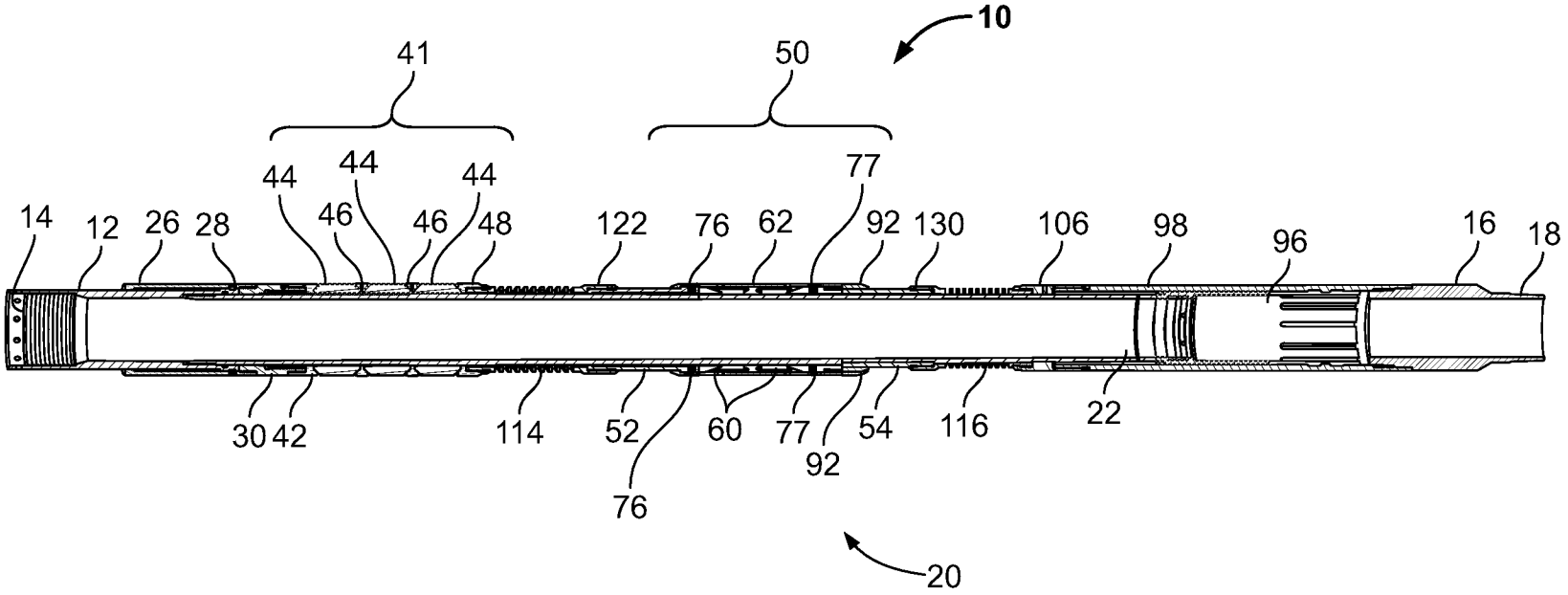
FIG. 2 is a side cross-sectional view of the packer of FIG. 1.
Figure 3:
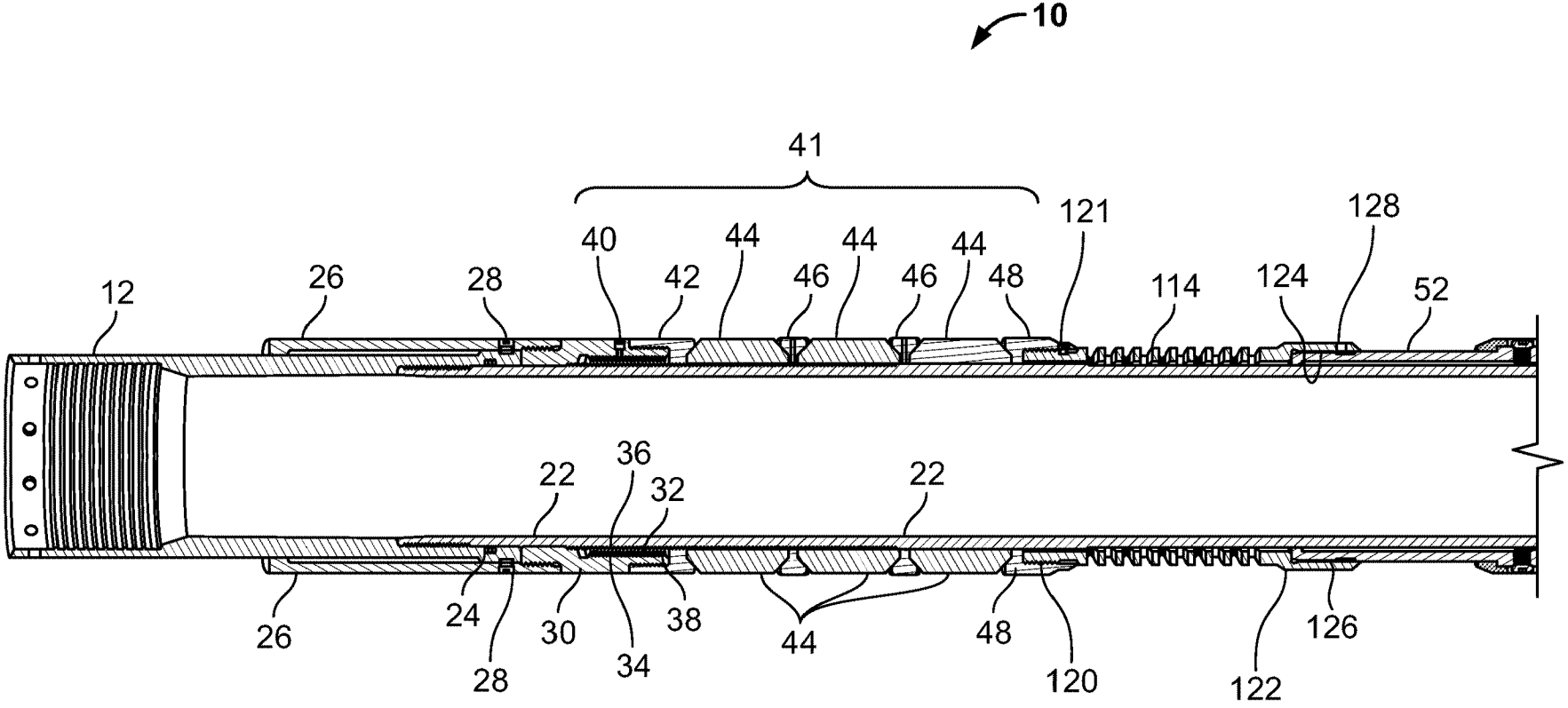
FIG. 3 is an enlarged top portion view of the packer shown in FIG. 2 showing the packing elements.

The packer body comprises a mandrel 22 extending generally between the top sub 12 and the bottom sub 16. The mandrel 22 comprises an elongate cylindrical body having a bore extending there-through. As shown in FIGS. 2 and 3, the top sub 12 is connected to the top end of the mandrel by means of a box and pin arrangement with cooperating threads. In one aspect, one or more O-rings, such as shown at 24, may be provided at an interface between the top sub 12 and the mandrel 22 so as to form a fluid seal there-between. As shown, the O-ring 24 may be accommodated within a recess formed in the top sub 12.

Figure 10:
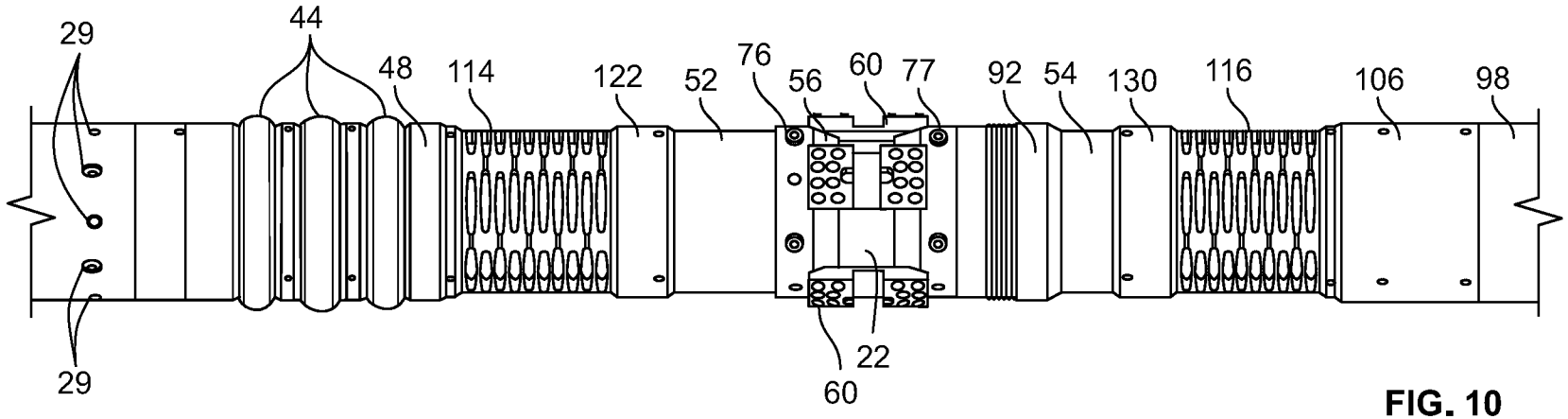
FIG. 10 is a side view of a portion of the packer of FIG. 1 in the set state with the packing elements and slips extended.
Figure 12:
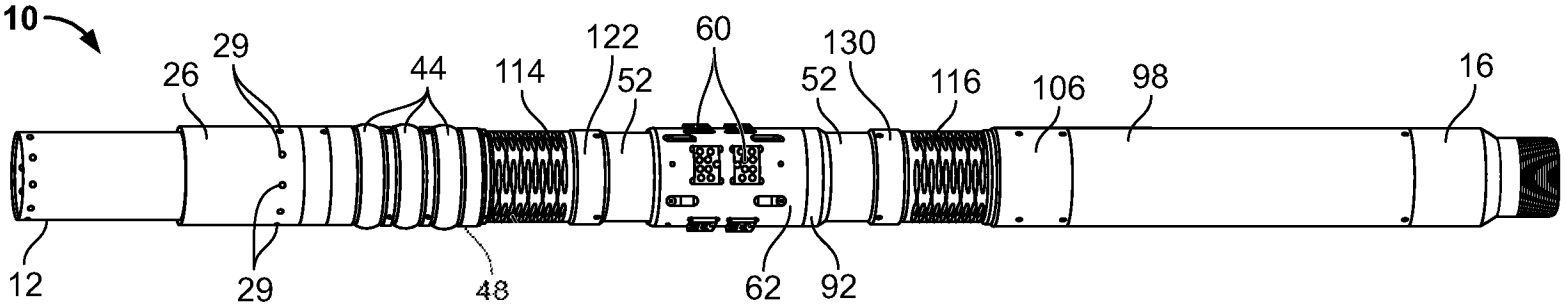
FIG. 12 is a side view of the packer of FIG. 1 in the set state.
Figure 13:
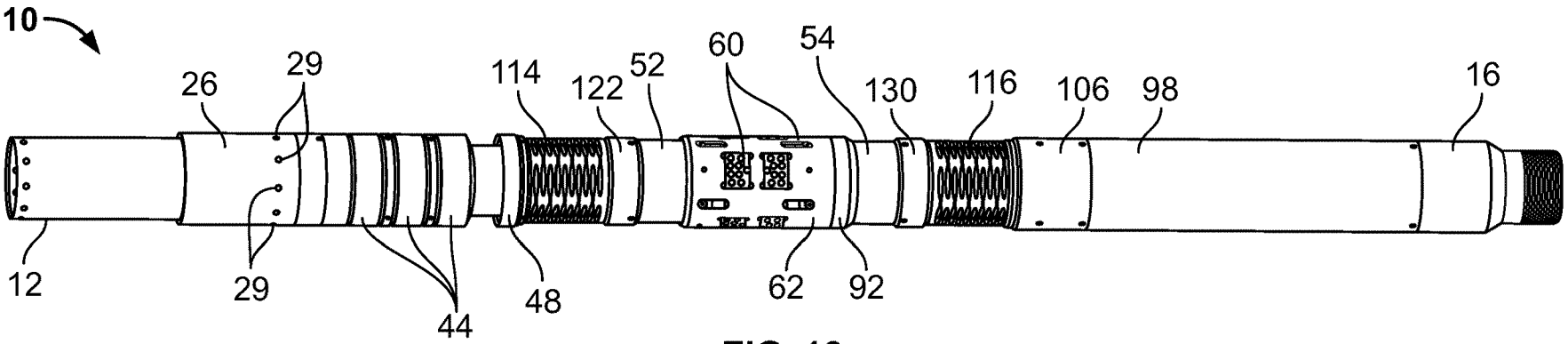
FIG. 13 is a side view of the packer of FIG. 1 showing the state when released from the set state.

Proximal to the top sup 12, and as more clearly shown in FIG. 3, the packer 10 comprises a stop housing 26, comprising a number of shear pins 28 that extend through apertures 29 (as shown in FIGS. 10, 12, and 13) connect the stop housing 26 with the top sub 12. As shown, a plurality of shear pins 28 are preferably provided circumferentially over the top sub 12 and generally equidistantly.

A locking ring housing 30 is provided over the mandrel 22 and over a locking ring 32 that is provided between the locking ring housing 30 and the mandrel 22. As illustrated in FIG. 3, the locking ring housing 30 may be connected to the stop housing 26 by means of a threaded connection. As also illustrated in FIG. 3, the locking ring 32 is provided with a number of teeth 34 on the outer surface thereof, which are adapted to cooperate with teeth 36 that are provided on the inner surface of the locking ring housing 30. The locking ring 32 is provided with a second set of teeth 36 on the inner surface thereof, which are adapted to cooperate with teeth 38 provided on the outer surface of the mandrel 22. A set screw 40 connects the locking ring housing 30 to the locking ring 32 so as to prevent or limit relative movement there-between. The teeth 36 and 38 are adapted to be directed in opposite directions, whereby relative axial movement between the locking ring 32 and the mandrel 22 is permitted in one direction. More specifically, the teeth 36 of the locking ring are directed in the uphole direction, whereas the teeth 38 of the mandrel 22 are directed in the downhole direction. As will be understood, with this arrangement, the locking ring 32 may be ratcheted over the mandrel in the downhole direction, but movement of the locking ring 32 with respect to the mandrel 22 in the uphole direction is prevented.

Opposite to the stop housing 26, the locking ring housing 30 is connected to a packing element assembly 41 comprising a gauge ring 42, which is coaxially provided over the mandrel 22 and is threadingly connected to the locking ring housing 30. As will be understood, with such connection, axial movement of the locking ring housing 30 over the mandrel 22 is translated to the gauge ring 42, resulting in axial movement of the gauge ring 42 over the mandrel. The downhole of the gauge ring 42 is provided with a number of packing elements 44, each separated by a spacer ring 46. Such packing elements and spacer rings are commonly known in the art. Following the last packing element, the packer 10 includes a retainer ring 48, which serves to complete the packing element assembly 41. In operation, when the packer 10 is actuated or set, the gauge ring 42 is advanced in the downhole direction thereby applying an axial force against the packing element assembly 41. In view of the resilient material forming the packing elements 44, the elements are forced to expand radially outward and thereby form a seal with the casing (not shown), as known in the art. In the present description, the retainer ring 48 is slidably provided over the mandrel 22, wherein the retainer ring 48 is permitted to be coaxially moved over the mandrel, the purpose of which is explained below.

The packer 10 also includes a slip assembly 50. In one aspect, the slip assembly 50 is provided downhole of the packing element assembly 41. The slip assembly comprises an upper cone 52 and a lower cone 54. As known the art, cones 52 and 54 comprise generally cylindrical ring structures having, at one end thereof, a wedge or ramped surface, such as shown at 56 and 58, respectively, in FIG. 4. As shown, the wedge surfaces 56 and 58 of the upper and lower cones 52 and 54 are oppositely directed. As is known in the art, a plurality of slips 60 are provided in a circumferentially spaced manner over the mandrel 22. A slip housing 62 is provided over the slips to retain the slips in position over the mandrel 22.

Figure 6:
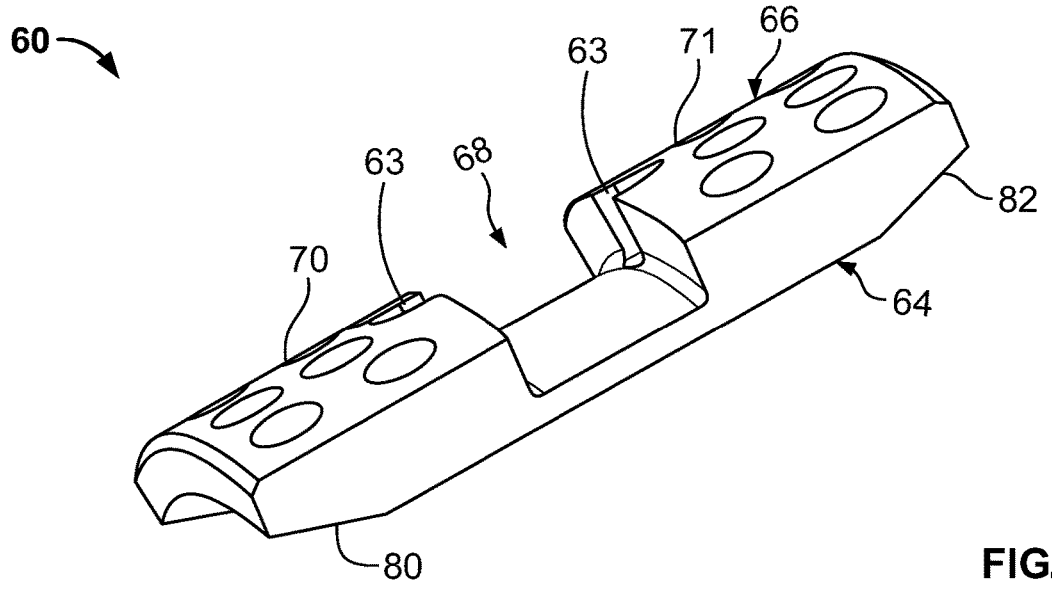
FIG. 6 is a side perspective view of a slip according to an aspect of the description.

FIG. 6 illustrates a slip 60 according to an aspect of the present description. As shown, the slip 60 comprises a unitary body having a generally concave inner surface 64, which faces the outer surface of the mandrel 22 and a generally convex outer surface 66. The outer surface comprises a groove 68 that divides the outer surface 66 into two casing engaging surfaces 70 and 71. The casing engaging surfaces are provided with a surface treatment or texture, or other such gripping means, that increases the gripping force of the slips once the packer is set. Such gripping means would be known to persons skilled in the art.

Figure 7:
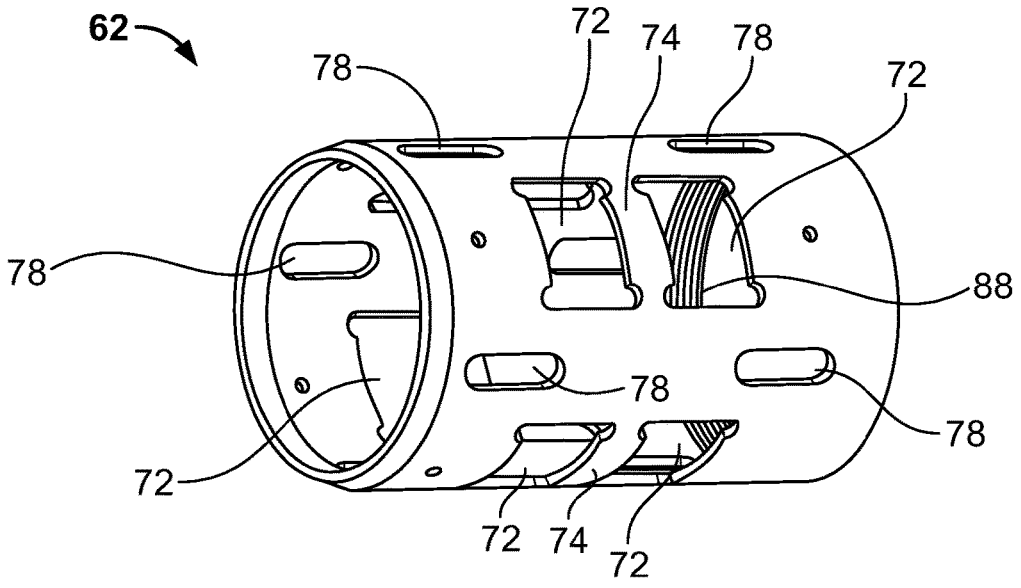
FIG. 7 is a side perspective view of a slip housing according to an aspect of the description.

FIG. 7 illustrates the slip housing 62, which comprises a cylindrical body adapted to overlap the mandrel 22 and the slips 60. The slip housing 62 includes a plurality of apertures 72 corresponding to the positions of the casing engaging surfaces 70 and 71, wherein the casing engaging surfaces are adapted to pass through the apertures 72. The apertures 72 is provided with a web 74 which is adapted to be received within the groove 68. In such way, the slips 60 are able to be extended through the apertures 72 to engage the casing when the packer is set, but the slips are prevented from passing completely through such apertures.

Figure 7A:
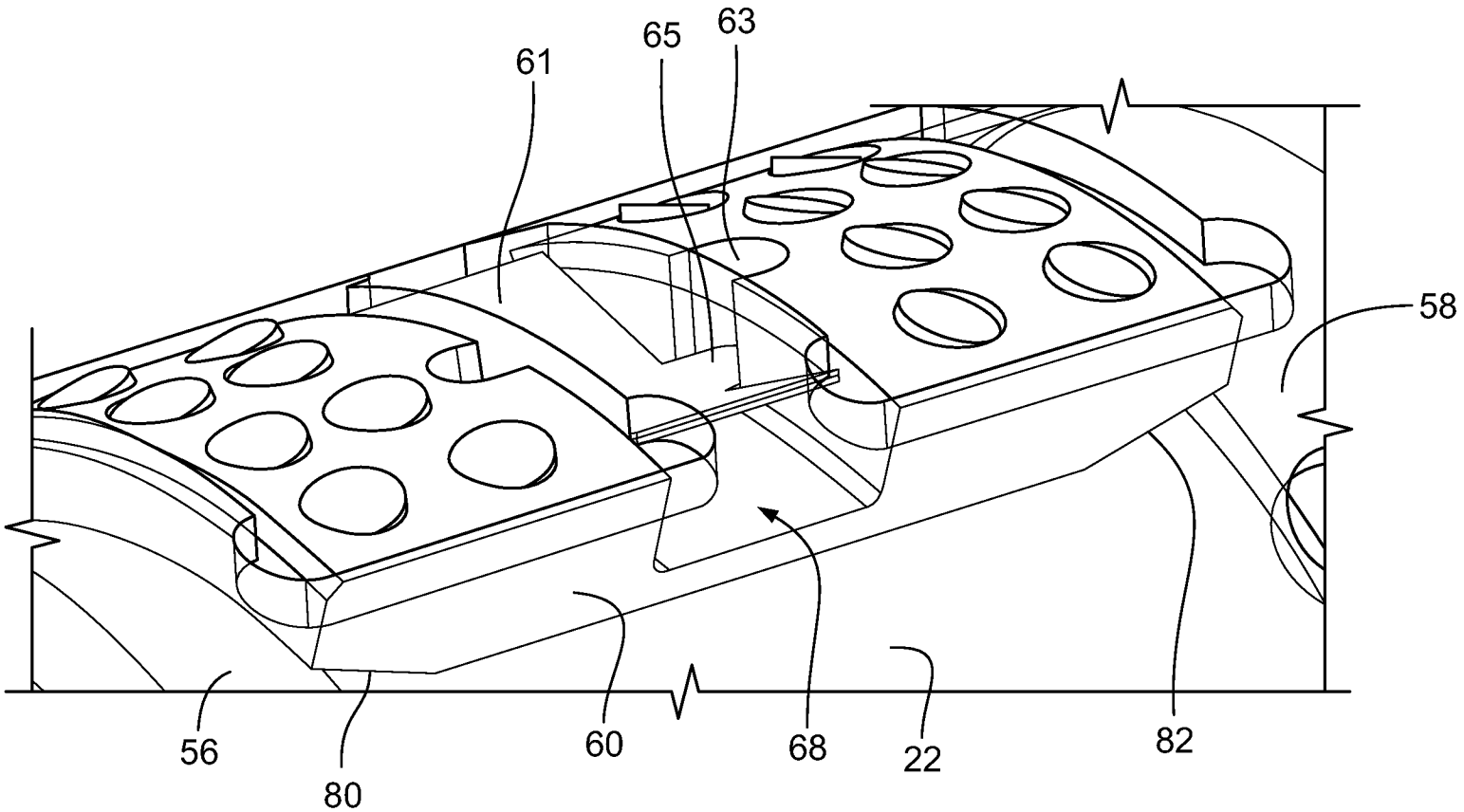
FIG. 7*a* is an enlarged section of a slip and slip housing when mounted on a mandrel. The slip housing is shown in phantom.

As is common in the art, slip springs are provided for urging slips 60 to return to the retracted state on the tool. In one aspect, a slip spring may be provided in the groove 68 of each slip 60, wherein such spring abuts the groove 68 and the inner surface of the web 74 of the slip housing 62 to bias the slip and the slip housing away from each other. As discussed above, the slip housing is coaxially provided over the mandrel, and, therefore, once the slip and slip housing assembly is mounted on a mandrel 22, the slip springs, which bias the slips 60 against the inner surface of the slip housing 62, urge, or act to retract, the slips radially inwardly, towards the mandrel 22. The slip springs may have any configuration as known in the art. In one aspect, the slip springs may comprise a leaf spring or a device similar thereto. One example of the slip springs is shown at 61 in FIG. 7*a*. As shown in this example, the slip spring 61 comprises a generally flat resilient member having a length adapted to fit within the groove 68. The opposed ends of the slip spring 61 are raised to contact the inner surface of the web 74 of the slip housing 74, which is shown in phantom in FIG. 7*a*. In the illustrated example, the slip 60 is provided with opposed guides 63 that are adapted to receive locating tabs 65 provided on each side of the slip spring 61. As will be understood, the positioning of the tabs 65 within the guides 63 of the slip serves to positively locate the slip spring 61, particularly during the assembly of the packer. It will be understood that the slip spring shown in FIG. 7*a* is only one example of a possible slip biasing means. As indicated above, springs and the like for biasing slips into the retracted position are known in the art.

Figure 4:
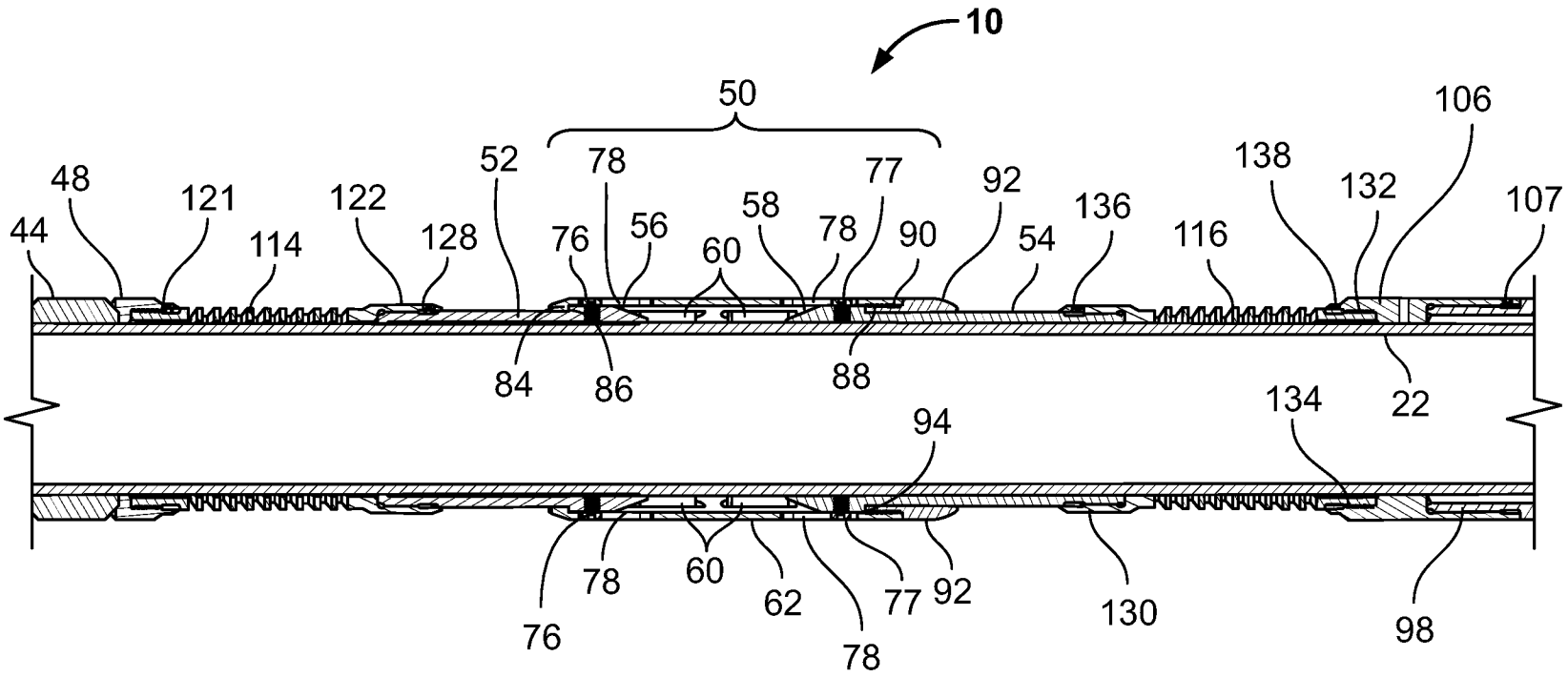
FIG. 4 is an enlarged mid-section view of the packer shown in FIG. 2, showing the slips.

As illustrated for example in FIGS. 1 and 4, the upper and lower cones 52 and 54 are provided with a number of circumferentially spaced pins or lugs 76 and 77, respectively, positioned proximal to the wedge surfaces, 56 and 58, thereof. The pins 76 and 77 are adapted to be received within slots 78 provided on the slip housing 62. As seen in FIGS. 1, 4, and 7, the slots 78 are aligned with the longitudinal axis of the housing 62 and, therefore, the packer 10. With this arrangement, the cones 52 and 54 are permitted a relative axial movement with the slip housing 62, but circumferential movement (i.e., relative axial rotation) there-between is prevented.

As also shown in FIG. 6, each of the slips are provided ramped surfaces 80 and 82 on opposite ends thereof. As known in the art, the ramped surfaces 80 and 82 are adapted to cooperate with the wedge surfaces 56 and 58 of the upper and lower cones 52 and 54, respectively. In particular, and as can be seen from FIG. 4, as the upper and lower cones 52 and 54 are axially advanced together, the wedge surfaces 56 and 58 engage oppositely directed ramp surfaces 80 and 82 of the slips and force the slips 60 to be radially extended through the apertures 72 of the slip housing 62. The degree of such radial extension is limited by the web 74 of the slip housing 62 and by the length of the slots 78 within which the pins 76 and 77 of the cones 52 and 54 are received.

As can be seen in FIG. 4, the top end of the slip housing 62 includes a shoulder 84 directed towards the bottom end thereof. The upper cone 52 includes a cooperating shoulder 86 that is directed to the top end thereof. As can be seen in FIG. 4, and as will be understood by persons skilled in the art, once the shoulders 84 and 86 abut each other the relative movement of the upper cone 52 and the slip housing 62 is limited.

The bottom end of the slip housing 62 is provided with a threaded inner surface 88 that is adapted to engage a correspondingly threaded outer surface 90 of a slip body cap 92, which serves to retain the slip housing. As illustrated in FIGS. 2 and 4, the top end of the slip body cap 92 is adapted to abut a shoulder 94 provided on the bottom cone 54. With this arrangement, the relative axial movement between the bottom cone 54 and the slip housing 62 is limited.

Figure 5:
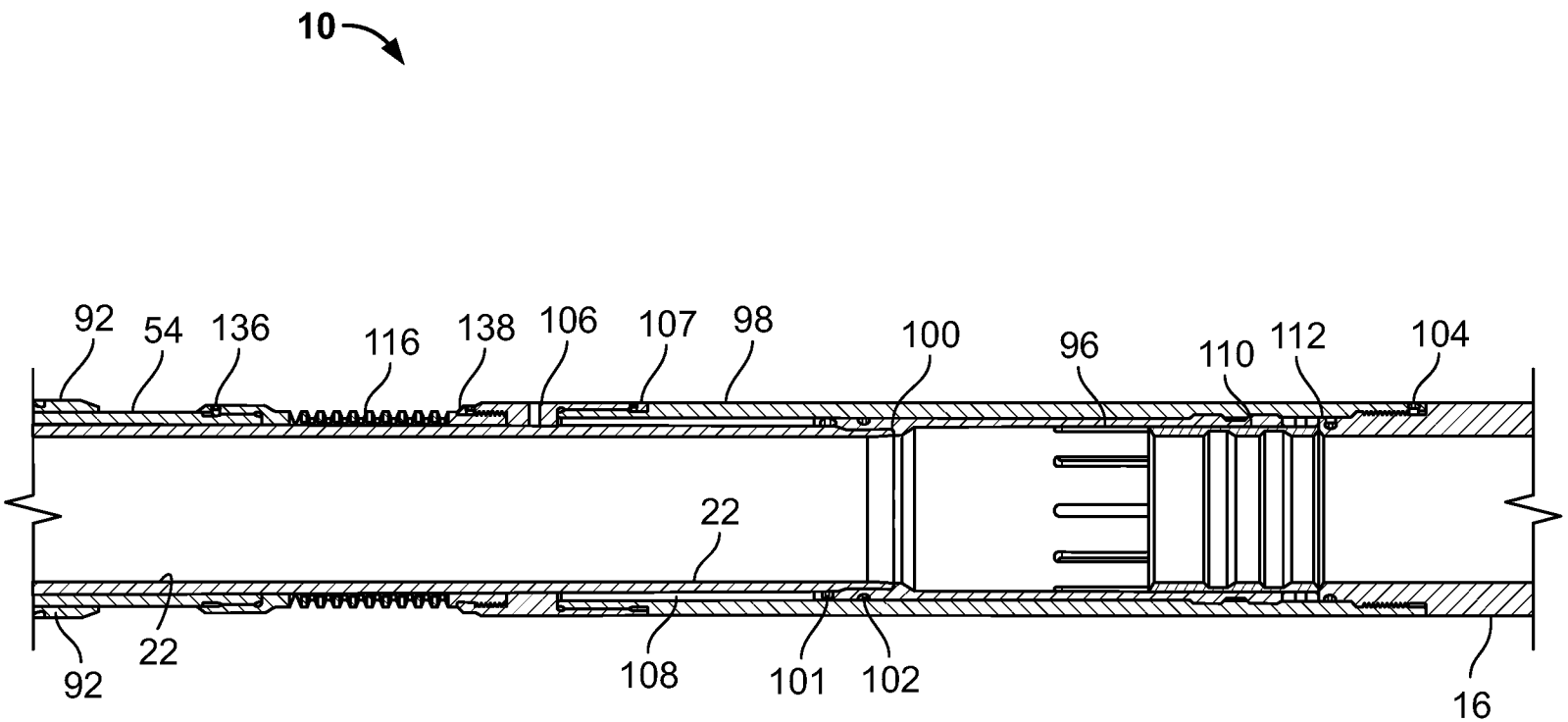
FIG. 5 is an enlarged bottom portion view of the packer shown in FIG. 2.

FIG. 5 illustrates the bottom portion of the packer 10 in the unset or run-in state. As shown, between the bottom end of the mandrel 22 and the bottom sub 16 there is provided a collet 96 and a collet housing 98. The collet 96 comprises a top end provided with a threaded inner surface, that is adapted to be secured to a complementary threaded end of the mandrel 22. The collet 96 includes a shoulder 100 adapted to bear against the end of the mandrel 22. The mandrel 22 and collet 96 are slidably provided within the collet housing 98. On or more seals such as O-rings 101, 102, or the like may be provided for forming a fluid seal between the collet 96 and the collet housing 98. The collet housing 98 has a bottom end with an inner threaded portion that is adapted to be connected to a correspondingly threaded portion of the bottom sub 16. Screws, such as shown at 104 may also be provided to connect the collet housing 98 to the bottom sub 16. The top end of the collet housing 98 is connected to a collet housing cap 106, coaxially provided over the mandrel 22. The bottom end of the collet housing cap 106 is provided with an internal threaded portion that is adapted to be connected to a correspondingly threaded outer portion at the top end of the collet housing 98, as shown in FIG. 5. One or more set screws 107 are provided to secure the collet housing cap 106 to the collet housing 98. The collet housing cap 106 is slidably provided on the mandrel 22, thereby allowing the collet housing cap 106 to be axially moved along the mandrel.

As shown in FIG. 5, when in the unset state, an annular space 108 is formed between the mandrel 22 and the collet housing 98, and which is bounded at the top end by the collet housing cap 106 and the top end of the collet 96. The annular space 108 is adapted to receive a portion of the collet 96 when the packer is released from the set state.

The bottom portion of the packer 10 is also provided with a release ring 110 and a shear cap 112. These components are designed to cooperate with a release tool (not shown) for releasing the packer 10 from the set state.

Returning again to FIGS. 1 and 2, the packer 10 is provided with an upper biasing member 114 and a lower biasing member 116. Each of the biasing members 114 and 116 comprise generally cylindrical bodies that are coaxially and slidably provided over the mandrel 22. The upper biasing member 114 is provided between the retaining ring 48 and the upper cone 52 and the lower biasing member 116 is provided between the lower cone 54 and the collet housing cap 106. The biasing members 114 and 116 are generally resilient, spring-like components that are adapted to be reversibly compressed and expanded along their longitudinal axes, the purpose of which is discussed below.

Figure 8:
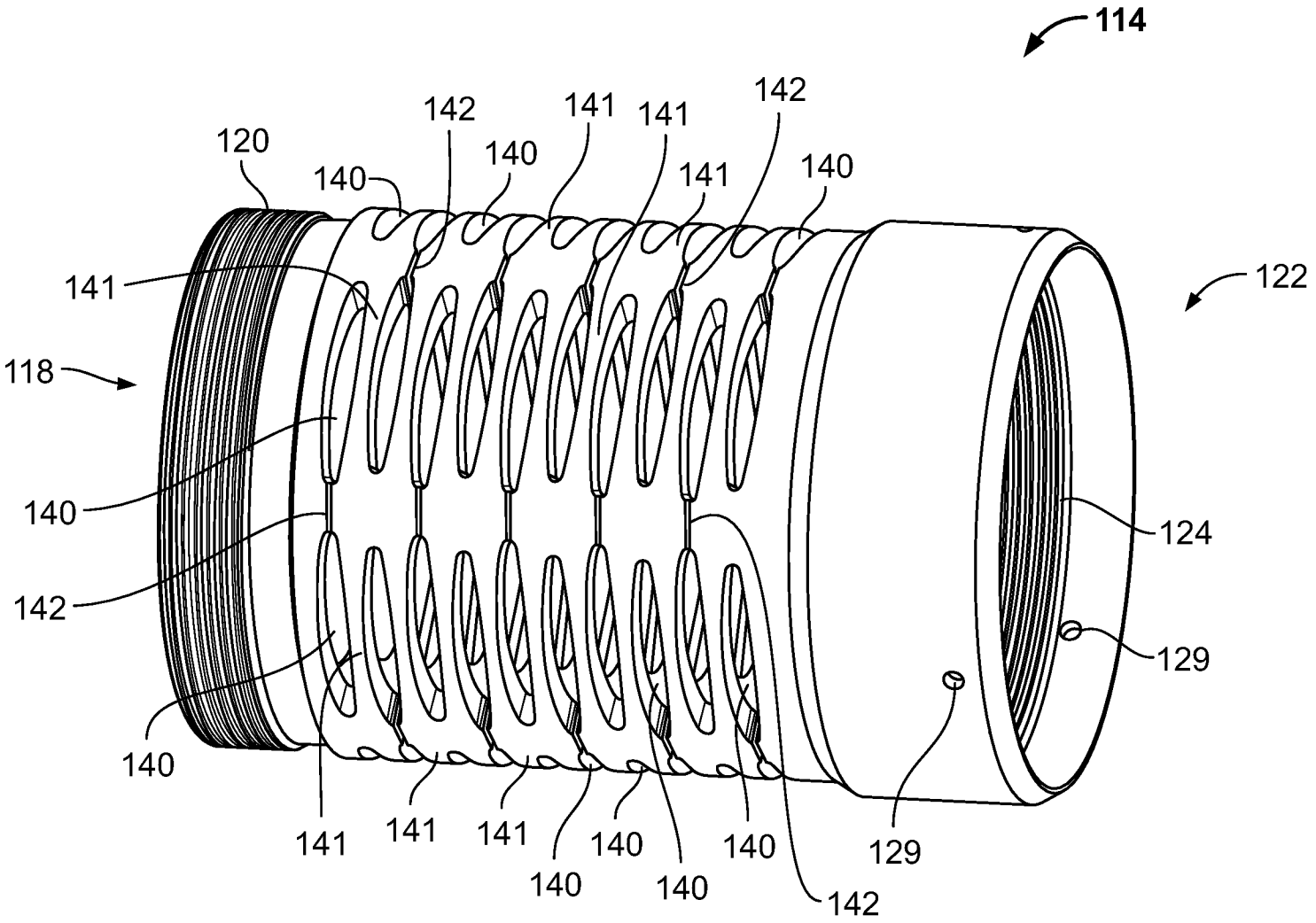
FIG. 8 is a side perspective view of the upper biasing member of the packer of FIG. 1.

FIG. 8 illustrates an aspect of the upper biasing member 114 in isolation. It will be understood that the lower biasing member 116 may be identical to the upper biasing member 114 but in reverse orientation. The biasing member 114 includes a top end 118 having a threaded outer surface 120 that is adapted to threadingly engage a correspondingly threaded inner surface of the retaining ring 48, as shown more clearly in FIG. 3. One or more set screws 121 is provided to secure the top end 118 of the upper biasing member 114 to the retaining ring 48 and to prevent axial relative movement there-between. The bottom end 122 of the upper biasing member 114 comprises an internal surface that is threaded 124 and adapted to engage a correspondingly threaded outer surface 126 provided on the top end of the upper cone 52. One or more set screws 128 are provided to secure the upper biasing member 114 to the upper cone 52. For this purpose, the bottom end 122 of the upper biasing member 114 is provided with one or more apertures 129 for receiving the one or more set screws 128. In this manner, the bottom end 122 of the biasing member is secured to the upper cone 52 thereby preventing relative axial movement there-between.

In a similar manner, and as illustrated in FIG. 4, the lower biasing member 116 is provided with a top end 130 having an internal bore that is adapted to be connected to an externally threaded portion of the lower cone 54. The lower biasing member 116 also includes a bottom end having an externally threaded portion 132 that is adapted to be secured to an internal bore 134 provided on collet housing cap 106. One or more set screws 136 and 138 are used to secure the top and bottom ends, respectively, of the lower biasing member to, respectively, the lower cone 54 and the collet housing cap 106.

In known packer and slip systems, the retaining ring 48 and collet housing cap 106 would typically be connected to the upper and lower cones, 52, 54, respectively. However, according to an aspect of the present description, and as illustrated in FIGS. 3 and 4, the biasing member 114 forms a connection between the retaining ring 48 of the packing element assembly 41 and the upper cone 52 and the biasing member 116 forms a connection between the collet housing cap 106 and the lower cone 54. In this manner, the biasing members 114 and 116 are adapted to function as springs, wherein axial forces transferred to the retaining ring 48 and the collet housing cap 106 are first absorbed, respectively, by the biasing members 114 and 116 and subsequently applied to the upper and lower cones. Thus, when an axial compressive force is applied against the packing element assembly 41, such as through the stop housing 26, such force is transmitted through the packing element assembly 41 and applied to the upper biasing member 114 resulting in axial loading thereof. If the applied force is greater than the counteracting resilience of the biasing member, the retaining ring 48 is permitted to slide downward over the mandrel 22, resulting in compression of the biasing member 114. Once no further compression of the biasing member is possible, further application of the axial force results in compression and setting of the packing elements 44 and the downward axial movement of the upper cone 52. The latter action results in the setting of the slips 60. Similarly, an upward movement of the collet housing cap 106, as would be caused by the aforementioned downward axial force (since the collet housing cap 106 is prevented from travelling downward in view of the collet housing 98), or by the upward movement of the mandrel 22, results in axial loading of the lower biasing member 116 and, ultimately, upward movement of the lower cone 54 against the slips 60. At this point, both the upper and lower biasing members 114 and 116 are in a compressed state and thereby apply a constant axially compressive force against the respective cones 52 and 54. As will be understood, this arrangement results in the slips 60 being in an energized state even in situations where the pressure in the well fluctuations.

According to one aspect of the description, and as illustrated in FIG. 8, the biasing members 114 and 116 may comprise a labyrinth structure, having a series of apertures 140. In a preferred aspect, the apertures comprise an elongate geometry, such as an oval geometry, having a major axis that extends circumferentially over the biasing member. In both the circumferential and axial directions, alternate pairs of apertures 140 are connected by a circumferentially extending slot 142 having a width. As illustrated in FIG. 8, this arrangement results in pairs of apertures 140 that are separated by slots 142. Consequently, the central body of the biasing member 114 generally comprises a plurality of resilient web members 141, resulting in the biasing member 114 being rendered resilient, particularly to axial forces. In this way, the biasing member functions as a spring by absorbing and/or transferring axial forces. In particular, and as illustrated in FIGS. 9 to 12, upon applying an axially compressive force against the opposed ends of the biasing member 114, the opposed ends are urged towards each other, due to the bending of the resilient web members 141, the widths of the slots 142 are narrowed. In this state, and due to the resiliency of the material forming the biasing member 114, the member is placed in a state of compression and has a tendency to axially expand to its original, elongated state. Similarly, if an axially expanding force is applied to the biasing member 114, that is a force that urges the ends thereof in axially opposite directions, the width of the slot 142 is increased and the member has a tendency to contract to its original state. It will be appreciated that the force absorption characteristics of the biasing member can be adjusted to suit a particular application by tailoring the material and/or width of the slots. The apertures 140 and slots 142 may be provided in any known manner. In one example, the biasing member may be formed by cutting the apertures and slots into a cylindrical structure.

In the present description, the body of the biasing members 114 and 116 are illustrated as having a labyrinth structure comprising a series of apertures and slots. As will be understood from the present description, such labyrinth structure of the biasing members, as illustrated in the accompanying figures, offers the advantage of a limit to the degree of contraction that the biasing member is subjected to. For example, once the slots 142 are narrowed to the extent that the opposed walls of the slots abut each other, it will be understood that no further contraction of the biasing member is possible. In this way, the slots provide a means of limiting axial contraction or compression of the biasing members. As will be understood, other physical structures may be provided on the walls of the slots to also serve to limit the degree of contraction. In such case, wider slots may be provided, but the degree of contraction of the biasing member still limited to a distance that is less than the overall width of the slots.

It will be understood that one or both of the biasing members may have other structures and/or geometries for achieving the desired purpose as described herein. For example, the biasing members may comprise wave springs, Belleville springs, or bellows assemblies, etc., and still provide the desired spring characteristics described above. Preferably, such other structures would be provided with a means to limit axial contraction in the same manner as achieved with the slots 142 described above.

Figure 9:
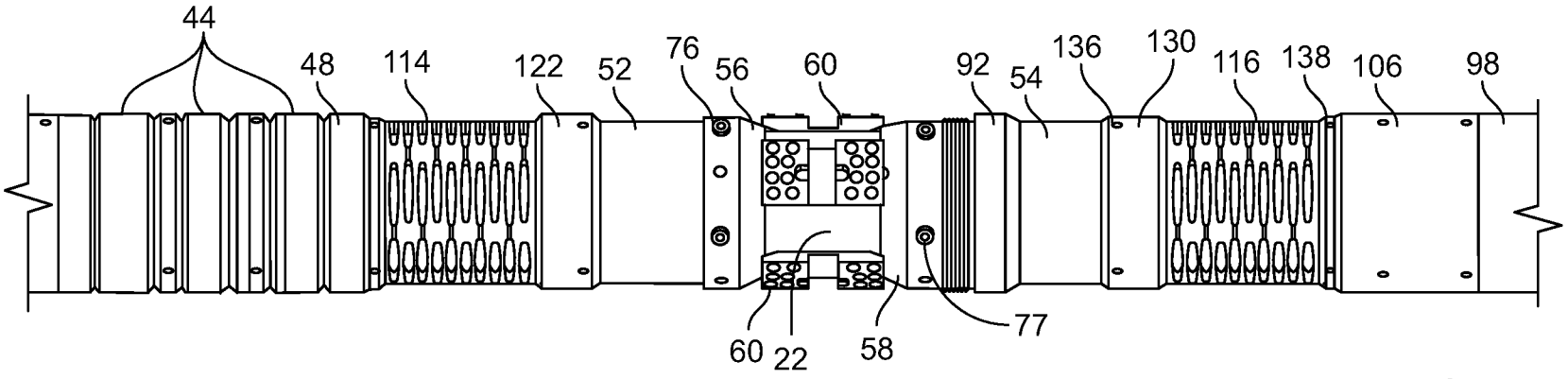
FIG. 9 is a side view of a portion of the packer of FIG. 1 in the unset or run-in state.
Figure 11:
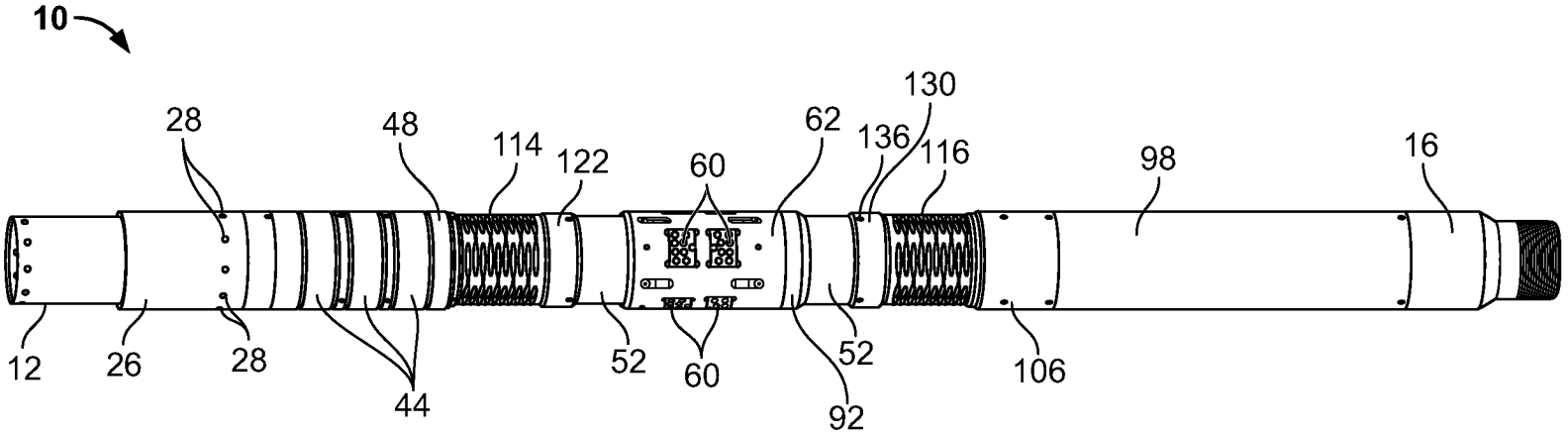
FIG. 11 a side view of the packer of FIG. 1 in the unset or run-in state.

FIGS. 9 to 13 illustrate the difference in configuration of the packer 10 between the set and unset states. FIGS. 9 and 10 show an enlarged portion of the packer 10 with the slip housing 62 omitted for ease of illustration. In the unset state, as illustrated in FIGS. 9 and 11, the upper cone 52 and lower cone 54 are in a separated position, and generally disengaged from the slips 60. As shown, the packing elements 44 are in a relaxed state. Similarly, the slips 60 are in their retracted state owing to the slip springs (not shown), as discussed above, located between the slips 60 and the slip housing 62. For setting the packer 10, a downward force is applied against the cylindrical components surrounding the mandrel 22. For example, the downward force may be applied against the stop housing 26. Simultaneously, an upward force may also be applied to the mandrel 22. In the course of this process, the shear pins 28 are sheared and a relative movement is caused between mandrel 22 and the coaxial structure surrounding it. Such movement is continued until the packer 10 reaches its set state at which point a locking mechanism is engaged to retain the packer 10 in such state. The setting of the packer 10 can be accomplished by the use of a setting tool as known in the art. Such tools are generally run-in the well and manipulated by wireline. The present description is not limited to any particular setting tool.

In the set state, as shown in FIGS. 10 and 12, the stop housing 26 has been forced downward, resulting in shearing of the shear pins 28 (leaving the apertures 29). As a result, the packing elements 44 of the packer 10 are compressed and the upper and lower cones, 52 and 54, are urged together. In the result, the wedge surfaces, 56, 58 of the upper and lower cones cooperate with the ramped surfaces of the slips 60, thereby causing the slips 60 to be forced radially outward. It will be appreciated that the degree of force imparted to the slips 60 would be greater than the counteracting force exerted by the slip springs discussed above. As also shown in FIGS. 10 and 12, when in the set state, the upper and lower biasing members 114 and 116 are compressed and, owing to their resilient nature, apply an axial expansion force on adjacent components. Since the upper end 122 of the upper biasing member 114 and the lower end of the lower biasing member 116 are generally immovable, it will be understood that such axial expansion force is thus applied to the upper and lower cones, 52 and 54, respectively. Consequently, such axial expansion force is maintained against the slips 60 resulting in the slips 60 being in an energized state. As discussed above, such constant energized state serves to enhance the gripping force applied by the slips, particularly during situations where the well pressure fluctuates.

In a preferred aspect, the amount of radially outward travel, or radial expansion, of the slips 60 would be predetermined based upon the internal diameter of the well (e.g., casing) and the external diameter of the packer 10. Further, in the set orientation, the slips 60 would preferably not be at the limit of their radial expansion. This arrangement results in the biasing members 114 and 116 applying a generally constant energizing force on the slips 60 while the packer is in the set state. This results in an improved packer, wherein the cones, and therefore the slips, remain in the set and energized state while in use, even in situations where the well pressure fluctuates or reverses. As a result, movement of actuated slips is avoided or minimized.

As mentioned earlier, the presently described packer is retrievable and, for this purpose, the packer is capable of being released from its set state and moved to another location in the well or extracted from the well. FIG. 13 illustrates the packer 10 when the set state is released. As shown, the mandrel 22 is disengaged from its locked position with respect to the coaxially arranged components and, as a result, the packing elements 44 are returned to their relaxed state and the biasing members 114 and 116 are relieved of the aforementioned axially compressive force. Consequently, the slips 60 are returned to their retracted position, as shown, as a result of the slip springs forcing the slips towards the mandrel. In this released state the packer 10 (i.e., the packing elements and the slips) no longer engages the casing and the packer is therefore moveable within the wellbore. Once moved to a desired position, the packer 10 may be re-set as described above using a setting tool.

As with the setting operation, the release of the packer 10 is accomplished by means of a release tool as would be known in the art. Such release tool is generally run-in and manipulated by wireline. The present description is not limited to any particular release tool.

In addition to the structure of the packer as discussed above, the present description also provides an improved method of operating a packer. In particular, as will be understood from the above description, the operation of a packer is improved by providing a constant axial force on cones that serve to actuate slips. As discussed above, while springs and the like are known for use directly on slips, mainly to force retraction of the slips when the expansion force is removed, the present description offers a unique advantage by applying axial forces on the cones that drive the outward expansion of the slips.

The present description has focused on a mechanically set packer, wherein wireline driven setting and release tools are used. However, the packer described herein can also be hydraulically actuated. In such case, coaxial components surrounding the mandrel would include valves and ports are known in the art, whereby an increase in pressure within the lumen of the mandrel serves to drive one or more pistons to result in relative axial movement between the mandrel and the coaxial components. However, it will be appreciated that the biasing members 114 and 116 would still function in the same manner as indicated above. In particular, whether the packer is designed for mechanical or hydraulic actuation, the biasing members would energize the slips once the packer is set.

In the above description, the packer 10 has been defined as having a bi-directional application of axial forces on the slips, using upper and lower cones. It will be understood that the biasing members described herein, and the aforementioned method, may also be incorporated into a packer having a unidirectional application of force on slips.

The slip assembly or apparatus has been described herein as being associated with a packer, such as packer 10. However, it will be appreciated that the slip assembly may be used with any downhole tool, such as bridge plugs, liner hangers or the like, where slips are commonly incorporated. The present description is not limited to any particular downhole tool.

In the present description, various components have been described as being slidable or slidably provided over the mandrel defined herein. It will be understood that the intent of such term is to indicate that the components in question need only be slidable over the relevant section of the mandrel where the components act and not necessarily along the entire length of the mandrel.

Although the above description includes reference to certain specific embodiments, various modifications thereof will be apparent to those skilled in the art. Any examples provided herein are included solely for the purpose of illustration and are not intended to be limiting in any way. Any drawings provided herein are solely for the purpose of illustrating various aspects of the description and are not intended to be drawn to scale or to be limiting in any way.

The scope of the claims appended hereto should not be limited by the preferred embodiments set forth in the above description but should be given the broadest interpretation consistent with the present specification as a whole. The disclosures of all prior art recited herein are incorporated herein by reference in their entirety.

We claim:

1. A slip assembly for a downhole tool, the slip assembly comprising:

a mandrel having a longitudinal axis;

a plurality of slips provided over the mandrel;

at least one generally cylindrical cone body coaxially provided over the mandrel and slidable over at least a portion thereof, the cone body having a first end directed away from the slips, and a second end adapted to engage and radially outwardly extend the slips;

at least one biasing member comprising a generally cylindrical body coaxially provided over the mandrel adjacent the first end of the at least one cone body, the biasing member being axially compressible and adapted to apply an axial force against the first end of the at least one cone body, wherein the axial force is in a direction towards the slips;

the at least one biasing member having first and second ends, wherein:

the first end of the at least one biasing member is attached to the first end of the cone body whereby relative bi-axial movement between the first end of the at least one biasing member and the cone body is prevented; and the second end of the at least one biasing member is attached to a ring member slidably provided over the mandrel whereby relative movement between the second end of the biasing member and the ring member is prevented.

2. The slip assembly of claim 1, wherein the assembly comprises two cone bodies, each adjacent opposite ends of the slips, and wherein a respective biasing member is provided adjacent each of the cone bodies.

3. The slip assembly of claim 2, wherein:

the second end of each of the cone bodies comprises a wedge surface; and, the slips have opposed ends facing respective second ends of the cone bodies, the opposed ends of the slips having wedge surfaces that are complementary to the wedge surfaces of the adjacent cone bodies;

whereby axial movement of the cone bodies against the slips urges the slips radially outward away from the mandrel.

4. The slip assembly of claim 3, wherein the slips are circumferentially spaced around the mandrel.

5. The slip assembly of claim 1, further comprising a biasing spring for urging the slips into a retracted position.

6. A downhole tool comprising the slip assembly of claim 1.

7. The downhole tool of claim 6, wherein the downhole tool is a packer.

8. The slip assembly of claim 1, wherein:

the second end of the at least one cone body comprises a wedge surface; and, the slips have an engagement end comprising a wedge surface that is complementary to the wedge surface of the cone body second end;

whereby axial movement of the cone body against the slips urges the slips radially outward away from the mandrel.

9. The slip assembly of claim 8, wherein the slips are circumferentially spaced around the mandrel.

10. The slip assembly of claim 1, wherein the biasing member is attached to the cone body by a threaded connection and/or the biasing member is attached to the ring member by a threaded connection.

11. The slip assembly of claim 1, wherein the biasing member comprises a reversibly compressible spring.

12. The slip assembly of claim 11, wherein the biasing member has a labyrinth structure.

13. A slip assembly for a downhole tool, the slip assembly comprising:

a mandrel having a longitudinal axis;

a plurality of slips provided over the mandrel, each of the slips having:

a longitudinal axis generally parallel to the longitudinal axis of the mandrel;

a first face, directed radially away from the mandrel;

a second face, directed towards the mandrel; and first and second ends;

at least one of the first and second ends having a ramped surface extending from the second face to the first face, whereby the length of the first face is longer than the second face;

at least one generally cylindrical cone body coaxially provided over the mandrel and slidable over at least a portion thereof, the at least one cone body having:

an inner surface facing the mandrel;

an outer surface facing away from the mandrel;

a first end directed away from the slips;

a second, slip engaging end, facing the slips;

the second end having a wedge surface;

wherein the wedge surface of the cone body is oppositely directed to the ramped surface of the slips, and whereby axial advancement of wedge surface towards the ramped surface forces radially outward movement of the slips; and, at least one biasing member comprising a generally cylindrical body coaxially provided over the mandrel adjacent the first end of the at least one cone body, the biasing member being axially compressible and adapted to apply an axial force against the first end of the at least one cone body, wherein the axial force is in a direction towards the slips;

the at least one biasing member having first and second ends, wherein:

the first end of the at least one biasing member is attached to the first end of the cone body whereby relative bi-axial movement between the first end of the at least one biasing member and the cone body is prevented; and the second end of the at least one biasing member is attached to a ring member slidably provided over the mandrel whereby relative bi-axial movement between the second end of the biasing member and the ring member is prevented.

14. The slip assembly of claim 13, wherein the assembly comprises two cone bodies, each adjacent opposite ends of the slips, and wherein a respective biasing member is provided adjacent each of the cone bodies.

15. The slip assembly of claim 13, further comprising a biasing spring for urging the slips into a retracted position.

16. A downhole tool comprising the slip assembly of claim 13.

17. The downhole tool of claim 16, wherein the downhole tool is a packer.

18. The slip assembly of claim 13, wherein the biasing member is attached to the cone body by a threaded connection and/or the biasing member is attached to the ring member by a threaded connection.

19. The slip assembly of claim 13, wherein the biasing member comprises a reversibly compressible spring.

20. The slip assembly of claim 19, wherein the biasing member has a labyrinth structure.

* * * * *